US010276908B2

(12) United States Patent
Huang et al.

(10) Patent No.: US 10,276,908 B2
(45) Date of Patent: Apr. 30, 2019

(54) ELECTROMAGNETIC WAVE TRANSMISSION BOARD AND DIFFERENTIAL ELECTROMAGNETIC WAVE TRANSMISSION BOARD

(71) Applicant: INDUSTRIAL TECHNOLOGY RESEARCH INSTITUTE, Hsinchu (TW)

(72) Inventors: Yu-Wei Huang, Hsinchu (TW); Shih-Hsien Wu, Taoyuan (TW); Wei-Chung Lo, Taipei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 19 days.

(21) Appl. No.: 15/468,796

(22) Filed: Mar. 24, 2017

(65) Prior Publication Data

US 2018/0183127 A1 Jun. 28, 2018

(30) Foreign Application Priority Data

Dec. 23, 2016 (TW) ..... 105143002 A

(51) Int. Cl.
*H01P 3/12* (2006.01)

(52) U.S. Cl.
CPC ..... *H01P 3/121* (2013.01)

(58) Field of Classification Search
CPC .. H01P 3/121; H01P 3/12; H01P 3/123; H01P 1/042
USPC ..... 333/239, 248, 208, 209
See application file for complete search history.

(56) References Cited

U.S. PATENT DOCUMENTS

| | | | | |
|---|---|---|---|---|
| 3,157,847 | A | 11/1964 | Williams | |
| 5,444,804 | A | 8/1995 | Yui et al. | |
| 6,438,304 | B1 | 8/2002 | Lawrence et al. | |
| 6,574,409 | B1 | 6/2003 | Moroni et al. | |
| 6,636,678 | B1 | 10/2003 | Bendett et al. | |
| 7,006,745 | B2 | 2/2006 | Etienne | |
| 7,415,183 | B2 | 8/2008 | Okano et al. | |
| 7,460,760 | B2 | 12/2008 | Cho et al. | |
| 8,058,953 | B2 | 11/2011 | Cho | |
| 8,299,878 | B2 * | 10/2012 | Pardo | H01P 3/121 333/239 |
| 8,830,585 | B2 | 9/2014 | Hirai et al. | |
| 9,383,515 | B2 | 7/2016 | Hayashi et al. | |

(Continued)

FOREIGN PATENT DOCUMENTS

| | | | |
|---|---|---|---|
| TW | 201009408 | A1 | 3/2010 |
| TW | 201518794 | A | 5/2015 |
| TW | 201610493 | A | 3/2016 |

OTHER PUBLICATIONS

"An FSK Plastic Waveguide Communication Link in 40nm CMOS" W. Volkaerts, et al., IEEE, 2015.

(Continued)

*Primary Examiner* — Stephen E. Jones
(74) *Attorney, Agent, or Firm* — Maschoff Brennan

(57) ABSTRACT

An electromagnetic wave transmission board comprises a substrate. The substrate comprises a first dielectric layer and a second dielectric layer, and the first dielectric layer is stacked on the second dielectric layer. The first dielectric layer and the second dielectric layer together form a wave guiding space. The wave guiding space is configured for transmitting electromagnetic wave.

17 Claims, 12 Drawing Sheets

(56) References Cited

U.S. PATENT DOCUMENTS

| | | | | |
|---|---|---|---|---|
| 9,423,561 | B1 | 8/2016 | Chou et al. | |
| 2004/0146247 | A1 | 7/2004 | Tsai et al. | |
| 2011/0254031 | A1 | 10/2011 | Yan et al. | |
| 2016/0077293 | A1 | 3/2016 | Jou et al. | |
| 2016/0238786 | A1 | 8/2016 | Gamer et al. | |
| 2017/0207510 | A1* | 7/2017 | Park | H01P 3/165 |

OTHER PUBLICATIONS

"High-Density Optical intemonnect exploiting build-up waveguide-on-SLC board" S. Nakagawa, et al., Electronic Components and Technology Conference, IEEE, 2008.
"Highly Reliable Silicone Based Optical Waveguides Embedded in PCBs" T. Lamprecht, et al. OSA, 2014.
"Polymer waveguides for electro-optical integration in data centers and high-performance computers" R. Dangel, et al., Optical Soceity of America, 2015.
"Thin glass based electro-optical circuit board (EOCB)" Henning Schroder, Lars Brusberg, IEEE, 2015.
TW Office Action dated Mar. 15, 2018 as received in Application No. 105143002.

* cited by examiner

30'

40'

50'

60'

70'

90

ELECTROMAGNETIC WAVE TRANSMISSION BOARD AND DIFFERENTIAL ELECTROMAGNETIC WAVE TRANSMISSION BOARD

CROSS-REFERENCE TO RELATED APPLICATIONS

This non-provisional application claims priority under 35 U.S.C. § 119(a) on Patent Application No(s). 105143002 filed in Taiwan, R.O.C. on Dec. 23, 2016, the entire contents of which are hereby incorporated by reference.

TECHNICAL FIELD

The disclosure relates to a transmission board.

BACKGROUND

In the electronics industry, printed circuit boards are often used as a means for transmitting electrical signals. In recent years, the amount of data to be processed by electronic goods is increasing, so is the amount of data to be transmitted by printed circuit boards. In order to transmit a large amount of data within a limited time, electrical signals must be transmitted at high speed or high frequency.

SUMMARY

One embodiment of the disclosure provides an electromagnetic wave transmission board comprising a substrate. The substrate comprises a first dielectric layer and a second dielectric layer, and the first dielectric layer is stacked on the second dielectric layer. The first dielectric layer and the second dielectric layer together form a wave guiding space. The wave guiding space is configured for transmitting electromagnetic wave.

One embodiment of the disclosure provides a differential electromagnetic wave transmission board comprising a substrate. The substrate comprises a first dielectric layer and a second dielectric layer, and the first dielectric layer is stacked on the second dielectric layer. The first dielectric layer and the second dielectric layer together form two wave guiding spaces arranged side by side. The two wave guiding spaces are configured for transmitting differential electromagnetic wave.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
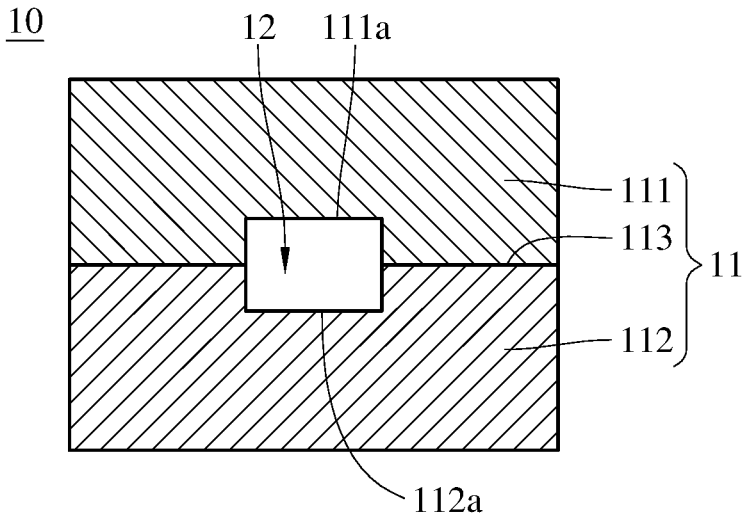
FIG. 1 is a cross-sectional view of an electromagnetic wave transmission board in accordance with one embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

The drawings may not be drawn to actual size or scale, some exaggerations may be necessary in order to emphasize basic structural relationships, while some are simplified for clarity of understanding, and the present disclosure is not limited thereto. It is allowed to have various adjustments under the spirit of the present disclosure. In the specification, the term "on" may be described as "one is located above another" or "one is in contact with another". In addition, the term "substantially" is referred to the complete or nearly complete extent or degree of a structure, which means that it is allowable to have tolerance during manufacturing.

Figure 2:
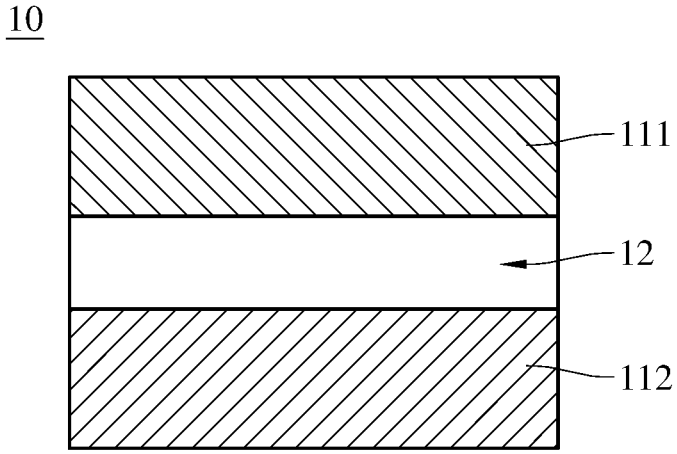
FIG. 2 is another cross-sectional view of the electromagnetic wave transmission board in FIG. 1.

Please refer to FIG. 1 and FIG. 2. FIG. 1 is a cross-sectional view of an electromagnetic wave transmission board 10 in accordance with one embodiment of the disclosure. FIG. 2 is another cross-sectional view of the electromagnetic wave transmission board 10 in FIG. 1. In this embodiment, the electromagnetic wave transmission board 10 includes a substrate 11. The substrate 11 includes a first dielectric layer 111, a second dielectric layer 112 and a connecting layer 113. The first dielectric layer 111 has a first groove 111*a*. A cross-section of the first groove 111*a* is rectangular. The second dielectric layer 112 has a second groove 112*a*. A cross-section of the second groove 112*a* is rectangular as well. The first dielectric layer 111 is stacked on the second dielectric layer 112. The first groove 111*a* and the second groove 112*a* face each other, and the first groove 111*a* and the second groove 112*a* together form a wave guiding space 12. The wave guiding space 12 is configured for transmitting electromagnetic wave. The connecting layer 113 connects the first dielectric layer 111 and the second dielectric layer 112. The connecting layer 113 is made of, for example, adhesive material. In this embodiment, both the first groove 111*a* and the second groove 112*a* are formed by laser marking, wet etching, dry etching or precision machining.

The first dielectric layer 111 and the second dielectric layer 112 are made of a dielectric material, such as glass or other dielectric materials. In this embodiment, the first dielectric layer 111 and the second dielectric layer 112 are made of the same dielectric material; however, in some other embodiments, the first dielectric layer 111 and the second dielectric layer 112 are made of different dielectric materials. A dielectric constant of the first dielectric layer 111 and a dielectric constant of the second dielectric layer 112 range from 1 to 100, wherein the dielectric constant is referred to as relative permittivity, which is a ratio of the (absolute) permittivity of a material relative to the permittivity of vacuum, in this embodiment. A surface roughness (Ra) of an inner surface of the wave guiding space 12 ranges from 0.1 nm to 100 nm. In this embodiment, the cross-section of the wave guiding space 12 is rectangular, but the present disclosure is not limited thereto. In other embodiments, the cross-section of the wave guiding space may be polygonal, circular, or elliptical.

The material used for filling the wave guiding space 12 is selected according to the external environment of the electromagnetic wave transmission board 10. For example, when the electromagnetic wave transmission board 10 is placed in a vacuum environment, there is a vacuum inside the wave guiding space 12. When the electromagnetic wave transmission board 10 is placed in an atmospheric environment, the inside of the wave guiding space 12 is filled with air. In some cases, the electromagnetic wave transmission board 10 may further include a filler (not shown in the drawings) according to actual requirements. The filler is filled in the wave guiding space 12. A dielectric constant of the filler is different from a dielectric constant of the first dielectric layer 111, and is also different from a dielectric constant of the second dielectric layer 112. Moreover, the dielectric constant of the filler is, for example, greater than the dielectric constant of the first dielectric layer 111 and the dielectric constant of the second dielectric layer 112.

Figure 3:
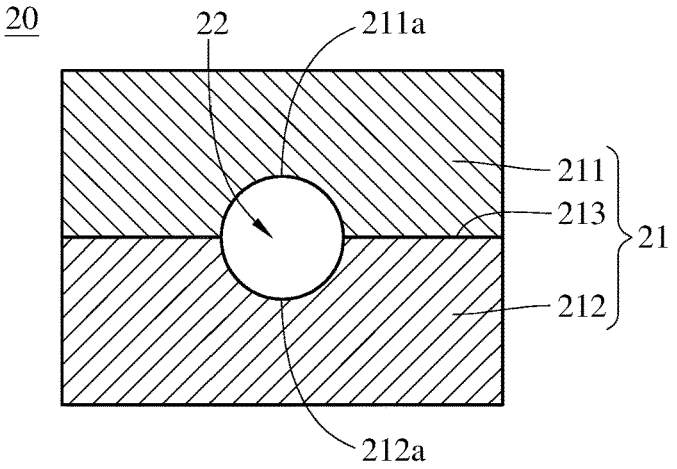
FIG. 3 is a cross-sectional view of an electromagnetic wave transmission board in accordance with another embodiment of the disclosure.

FIG. 3 is a cross-sectional view of an electromagnetic wave transmission board 20 in accordance with another embodiment of the disclosure. In this embodiment, a first dielectric layer 211 and a second dielectric layer 212 of a substrate 21 respectively have a first groove 211*a* and a second groove 212*a*. The cross-sections of the first groove 211*a* and the second groove 212*a* are semicircular. A connecting layer 213 connects the first dielectric layer 211 and the second dielectric layer 212. The first groove 211*a* and the second groove 212*a* together form a wave guiding space 22 which is a cylindrical cavity.

Figure 4:
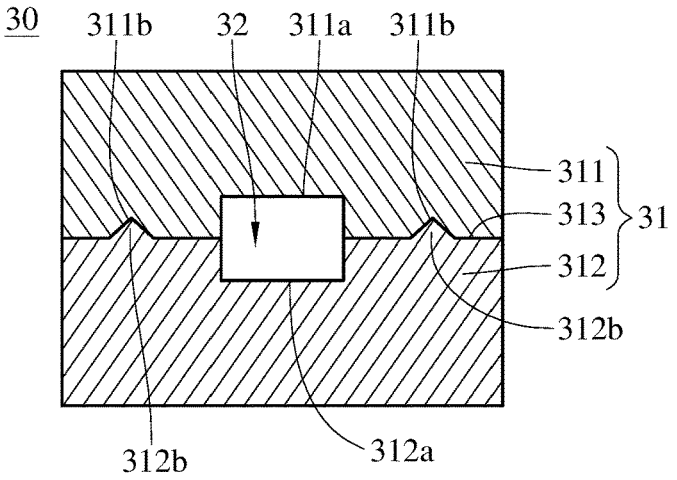
FIG. 4 is a cross-sectional view of an electromagnetic wave transmission board in accordance with still another embodiment of the disclosure.

Please refer to FIG. 4, which is a cross-sectional view of an electromagnetic wave transmission board 30 in accordance with another embodiment of the disclosure. In this embodiment, the electromagnetic wave transmission board 30 includes a substrate 31. The substrate 31 includes a connecting layer 313, a first dielectric layer 311 and a second dielectric layer 312. The first dielectric layer 311 is stacked on the second dielectric layer 312. The first dielectric layer 311 and the second dielectric layer 312 respectively have a first groove 311*a* and a second groove 312*a*. The cross-sections of the first groove 311*a* and the second groove 312*a* are, but not limited to, rectangular. The first groove 311*a* and the second groove 312*a* face each other and together form a wave guiding space 32. Additionally, the first dielectric layer 311 further has two first positioning portions 311*b*, and the second dielectric layer 312 further has two second positioning portions 312*b*. In this embodiment, each first positioning portion 311*b* is a recess, and each second positioning portion 312*b* is a block. Each first positioning portion 311*b* and the corresponding second positioning portion 312*b* are engaged with each other so as to enhance the positioning effect and prevent misalignment between the first groove 311*a* and the second groove 312*a*, and therefore prevent a deformation of the wave guiding space 32 formed by the first groove 311*a* and the second groove 312*a* together. The connecting layer 313 connects the first dielectric layer 311 and second dielectric layer 312.

In other embodiments, the first dielectric layer may have one or more than two first positioning portions, and the second dielectric layer may have one or more than two second positioning portions. In addition, each first positioning portion may be a block instead of a recessed configuration, and each second positioning portion may be a recess instead of a block.

In this embodiment, the second dielectric layer 312 is integrally formed with the two second positioning portions 312*b*, but the present disclosure is not limited thereto. In other embodiments, the second positioning portions and the second dielectric layer are separate members, and the second positioning portions are disposed on the second dielectric layer as positioning portions.

In this embodiment, the first positioning portions 311*b* and the second positioning portions 312*b* are tightly in contact with each other, but the present disclosure is not limited thereto. In some other embodiments, the first positioning portions may extend deeper into the first dielectric layer, such that there may be gaps between each first positioning portion and the corresponding second positioning portion after they are engaged with each other. Therefore, mechanical interference due to manufacturing tolerances during assembly can be prevented.

In FIG. 4, the materials of the first dielectric layer 311 and the second dielectric layer 312, a surface roughness (Ra) of an inner surface of the wave guiding space 32, the shape of the wave guiding space 32 and a material filled the wave guiding space 32 are, for example, the same as those of the electromagnetic wave transmission board 10 in FIG. 1.

Figure 5:
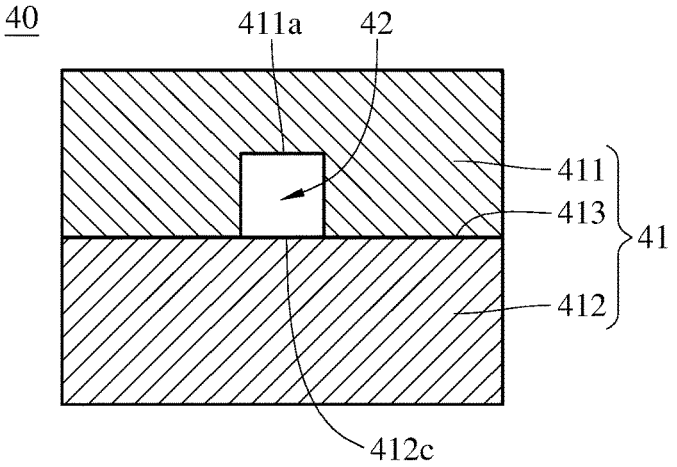
FIG. 5 is a cross-sectional view of an electromagnetic wave transmission board in accordance with yet another embodiment of the disclosure.

Please refer to FIG. 5, which is a cross-sectional view of an electromagnetic wave transmission board 40 in accordance with another embodiment of the disclosure. In this embodiment, the electromagnetic wave transmission board 40 includes a substrate 41. The substrate 41 includes a connecting layer 413, a first dielectric layer 411 and a second dielectric layer 412. The first dielectric layer 411 is stacked on the second dielectric layer 412. The first dielectric layer 411 has a groove 411*a*. The cross-section of the groove 411*a* is, but not limited to, rectangular. The groove 411*a* faces a surface 412*c* of the second dielectric layer 412. The groove 411*a* and the surface 412*c* of the second dielectric layer 412 together form a wave guiding space 42. Therefore, it is not necessary to align two grooves with each other so as to be favorable for obtaining an easier assembly of the dielectric layers 411, 412. The connecting layer 413 connects the first dielectric layer 411 and the second dielectric layer 412.

In FIG. 5, the materials of the first dielectric layer 411 and the second dielectric layer 412, a surface roughness (Ra) of an inner surface of the wave guiding space 42, the shape of the wave guiding space 42 and a material filled the wave guiding space 42 are, for example, the same as those of the electromagnetic wave transmission board 10 in FIG. 1.

Figure 6:
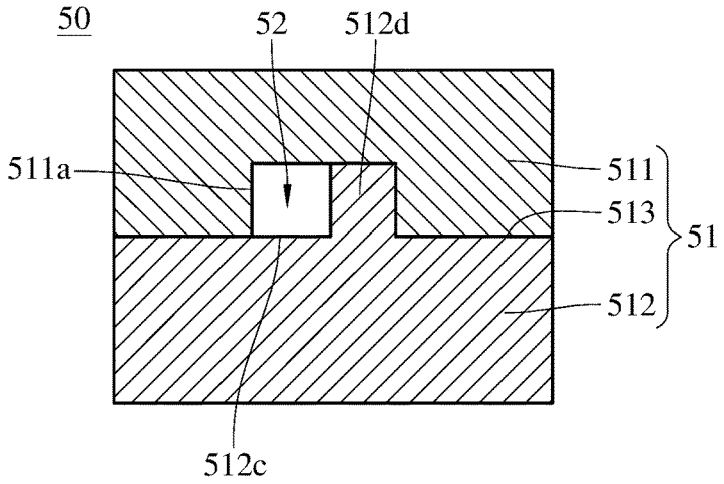
FIG. 6 is a cross-sectional view of an electromagnetic wave transmission board in accordance with yet still another embodiment of the disclosure.

Please refer to FIG. 6, which is a cross-sectional view of an electromagnetic wave transmission board 50 in accordance with another embodiment of the disclosure. In this embodiment, electromagnetic wave transmission board 50 includes a substrate 51. The substrate 51 includes a connecting layer 513, a first dielectric layer 511 and a second dielectric layer 512. The first dielectric layer 511 is stacked on the second dielectric layer 512. The first dielectric layer 511 has a groove 511*a*. The cross-section of the groove 511*a* is, but not limited to, rectangular. The second dielectric layer 512 has a surface 512*c* and a protrusion 512*d* protruding from the surface 512*c*. A width of the groove 511*a* is larger than a width of the protrusion 512*d*. The protrusion 512*d* is disposed in the groove 511*a*, and located adjacent to one side wall of the groove 511*a*. The groove 511*a*, the protrusion 512*d* and the surface 512*c* of the second dielectric layer 512 together form a wave guiding space 52. The groove 511*a* and the protrusion 512*d* are engaged with each other so as to meet the requirement of the alignment between the first dielectric layer 511 and the second dielectric layer 512. The connecting layer 513 connects the first dielectric layer 511 and the second dielectric layer 512. In this embodiment, the second dielectric layer 512 is integrally formed with the protrusion 512*d*, but the present disclosure is not limited thereto. In other embodiments, the protrusion and the second dielectric layer are separate members, and the protrusion is disposed on the second dielectric layer as a positioning portion.

A material of the first dielectric layer 511, a material of the second dielectric layer 512, a surface roughness (Ra) of an inner surface of the wave guiding space 52, the shape of the wave guiding space 52 and a material for filling the wave guiding space 52 are, for example, the same as those of the electromagnetic wave transmission board 10 in FIG. 1.

Figure 7:
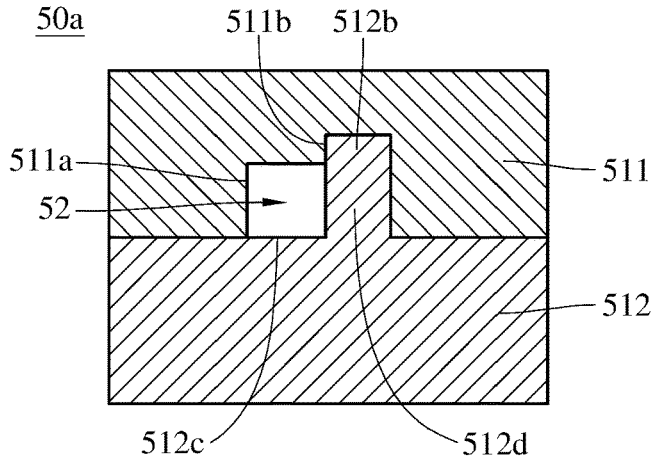
FIG. 7 is a cross-sectional view of an electromagnetic wave transmission board in accordance with yet still another embodiment of the disclosure.

Please refer to FIG. 7, which is a cross-sectional view of an electromagnetic wave transmission board 50*a* in accordance with another embodiment of the disclosure. In this embodiment, the electromagnetic wave transmission board 50*a* is similar to the electromagnetic wave transmission board 50 in FIG. 6. The differences between the two embodiments are that: in this embodiment, the first dielectric layer 511 has the groove 511*a* and a recess 511*b* located on a side of the first dielectric layer 511 facing the second dielectric layer 512; the groove 511*a* is connected to the recess 511*b*; and the second dielectric layer 512 has the surface 512*c*, the protrusion 512*d* protruding from the surface 512*c*, and a block 512*b* located on top of the protrusion 512*d*. In detail, a width of the block 512*b* is substantially equal to the width of the protrusion 512*d*. The protrusion 512*d* is disposed in the groove 511*a*. The recess 511*b* and the block 512*b* are engaged with each other. The groove 511*a*, the protrusion 512*d* and the surface 512*c* of the second dielectric layer 512 together form the wave guiding space 52. In this embodiment, the recess 511*b* and the block 512*b* are, but not limited to, tightly in contact with each other.

Figure 8:
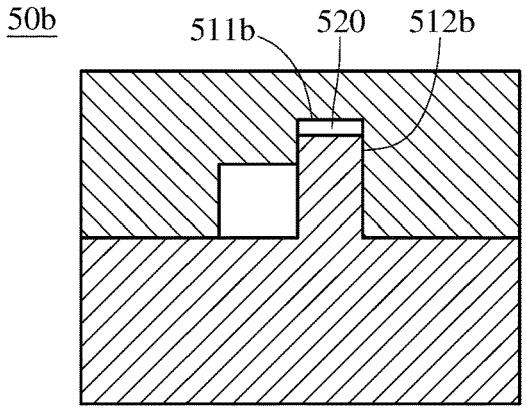
FIG. 8 is a cross-sectional view of an electromagnetic wave transmission board in accordance with yet still another embodiment of the disclosure.

Please refer to FIG. 8, which is a cross-sectional view of an electromagnetic wave transmission board 50*b* in accordance with another embodiment of the disclosure. In this embodiment, the electromagnetic wave transmission board 50*b* is similar to the electromagnetic wave transmission board 50*a* in FIG. 7. The difference between the two embodiments is that, in this embodiment, the depth of the recess 511*b* in the first dielectric layer 511 is deeper, such that there is a gap 520 when the recess 511*b* and the block 512*b* are engaged with each other. Therefore, mechanical interference due to manufacturing tolerances during assembly can be prevented.

Figure 9:
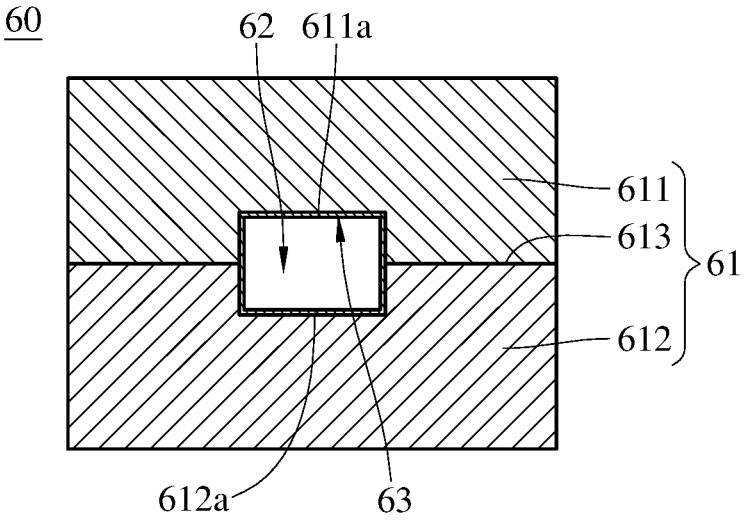
FIG. 9 is a cross-sectional view of an electromagnetic wave transmission board in accordance with yet still another embodiment of the disclosure.

Please refer to FIG. 9, which is a cross-sectional view of an electromagnetic wave transmission board 60 in accordance with another embodiment of the disclosure. In this embodiment, the electromagnetic wave transmission board 60 is similar to the electromagnetic wave transmission board 10 in FIG. 1. A substrate 61 of the electromagnetic wave transmission board 60 also includes a connecting layer 613 connects a first dielectric layer 611 and a second dielectric layer 612 of the substrate 61. However, the differences between the two embodiments are that the electromagnetic wave transmission board 60 further includes an auxiliary layer 63 disposed on an inner surface of a first groove 611*a* of the first dielectric layer 611 and an inner surface of a second groove 612*a* of the second dielectric layer 612. In other words, the auxiliary layer 63 is disposed on an inner surface of a wave guiding space 62 formed by the first groove 611*a* and the second groove 612*a* together. The auxiliary layer 63 is made of an electrically conductive material or a dielectric material. The electrically conductive material is, for example, a metal or a non-metallic material. A dielectric constant of the dielectric material is, for example, different from a dielectric constant of the first dielectric layer 611 and a dielectric constant of the second dielectric layer 612. For example, the dielectric constant of the dielectric material of the auxiliary layer 63 is 1000 or more. In this embodiment, the dielectric constant is referred to as the relative permittivity which is a ratio of the permittivity of the dielectric material relative to the permittivity of vacuum. The dielectric material is, for example, $BaTiO_3$.

A material of the first dielectric layer 611, a material of the second dielectric layer 612 and the shape of the wave guiding space 62 are, for example, the same as those of the electromagnetic wave transmission board 10 in FIG. 1. A surface roughness (Ra) of an inner surface of the auxiliary layer 63 ranges from, for example, 0.1 nm to 100 nm. According to the external environment of the electromagnetic wave transmission board 60, there is vacuum, air or other gases inside the auxiliary layer 63. In some cases, the electromagnetic wave transmission board 60 may further include a filler (not shown in the drawings) according to requirements. The auxiliary layer 63 forms an accommodation portion in the wave guiding space 62, and the filler is filled in the accommodation portion. A dielectric constant of the filler is, for example, different from the dielectric constants of the first dielectric layer 611, the second dielectric layer 612 and the auxiliary layer 63. Moreover, the dielectric constant of the filler is, for example, greater than the dielectric constants of the first dielectric layer 611 and the second dielectric layer 612.

Figure 10:
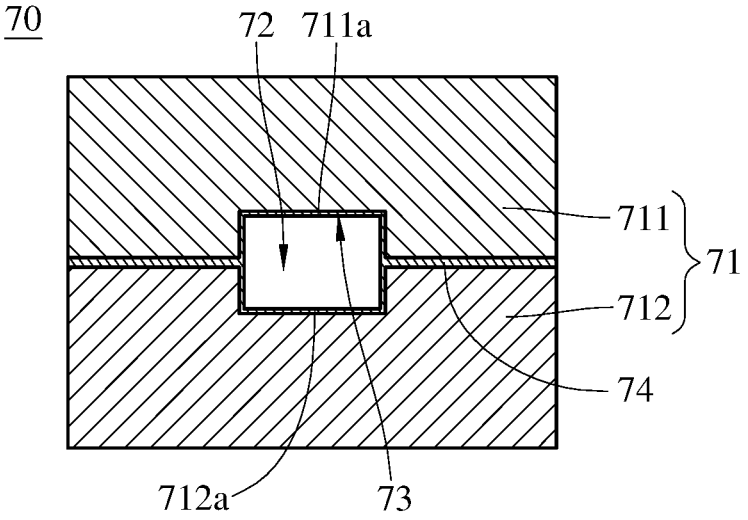
FIG. 10 is a cross-sectional view of an electromagnetic wave transmission board in accordance with yet still another embodiment of the disclosure.

Please refer to FIG. 10, which is a cross-sectional view of an electromagnetic wave transmission board 70 in accordance with another embodiment of the disclosure. In this embodiment, the electromagnetic wave transmission board 70 is similar to the electromagnetic wave transmission board 60 in FIG. 9. The electromagnetic wave transmission board 70 includes a substrate 71 and an auxiliary layer 73. The auxiliary layer 73 is disposed on an inner surface of a first groove 711*a* and an inner surface of a second groove 712*a*. In other words, the auxiliary layer 73 is disposed on an inner surface of a wave guiding space 72. The differences between the electromagnetic wave transmission board 70 and the electromagnetic wave transmission board 60 are that the electromagnetic wave transmission board 70 further includes an interlayer 74 replacing the connecting layer 613 in FIG. 9. In detail, the interlayer 74 is stacked between a first dielectric layer 711 and a second dielectric layer 712, and the interlayer 74 connects the first dielectric layer 711 and the second dielectric layer 712. The interlayer 74 is connected to the auxiliary layer 73, and a material of the interlayer 74 is the same as a material of the auxiliary layer 73, but the present disclosure is not limited thereto. In other embodiments, the material of the interlayer 74 may be different from the material of the auxiliary layer 73.

A material of the first dielectric layer 711, a material of the second dielectric layer 712 and the shape of the wave guiding space 72 are, for example, the same as those of the electromagnetic wave transmission board 10 in FIG. 1. A surface roughness (Ra) of an inner surface of the auxiliary layer 73 and a material for filling the auxiliary layer 73 are, for example, the same as those of the electromagnetic wave transmission board 60 in FIG. 9.

In the electromagnetic wave transmission boards 10, 20, 30, 40, 50, 60, 70 described above, a plurality of wave guiding spaces may be formed according to requirements. Further, the aforementioned electromagnetic wave transmission boards 10, 20, 30, 40, 50, 60, 70 may be respectively chosen and be connected to form a single one electromagnetic wave transmission board according to requirements. For example, multiple electromagnetic wave transmission boards 10 are chosen to be connected together; or alternatively, one electromagnetic wave transmission board 10 and one electromagnetic wave transmission board 20 are chosen to be connected together.

Figure 11:
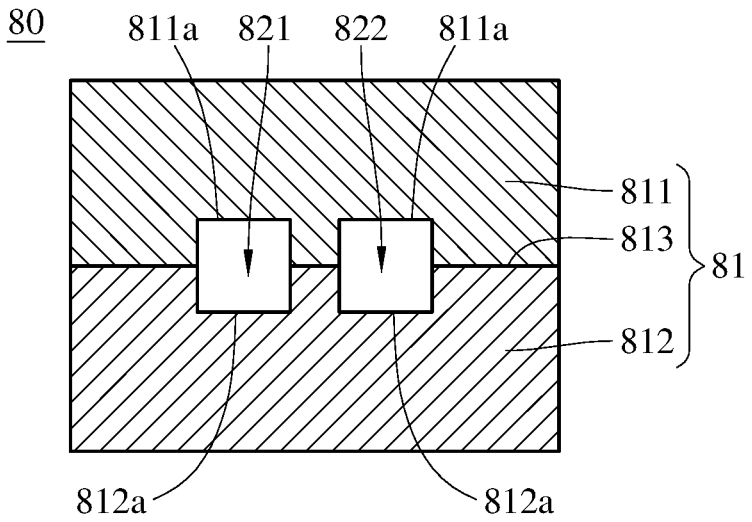
FIG. 11 is a cross-sectional view of a differential electromagnetic wave transmission board in accordance with yet still another embodiment of the disclosure.

Please refer to FIG. 11, which is a cross-sectional view of a differential electromagnetic wave transmission board 80 in accordance with one embodiment of the disclosure. In this embodiment, the differential electromagnetic wave transmission board 80 includes a substrate 81. The substrate 81 includes a first dielectric layer 811, a second dielectric layer 812 and a connecting layer 813. The first dielectric layer 811 has two first grooves 811*a* arranged side by side. The cross-sections of the two first grooves 811*a* are rectangular. The second dielectric layer 812 has two second grooves 812*a*. The cross-sections of the two second grooves 812*a* are rectangular. The first dielectric layer 811 is stacked on the second dielectric layer 812. Each first groove 811*a* and the corresponding second groove 812*a* face each other. One set of the first groove 811*a* and the second groove 812*a* form a wave guiding space 821, and the other set of the first groove 811*a* and the second groove 812*a* form a wave guiding space 822. The wave guiding space 821 and the wave guiding space 822 are arranged side by side. The connecting layer 813 connects the first dielectric layer 811 and the second dielectric layer 812. The wave guiding space 821 and the wave guiding space 822 are configured for transmitting differential electromagnetic wave. In detail, a configuration of the differential electromagnetic wave transmission board 80 is similar to that of the electromagnetic wave transmission board 10 in FIG. 1. The difference between the two embodiments is that, in this embodiment, there are two wave guiding spaces 821 and 822 formed in the differential electromagnetic wave transmission board 80 and arranged side by side for transmitting differential signals.

Figure 12:
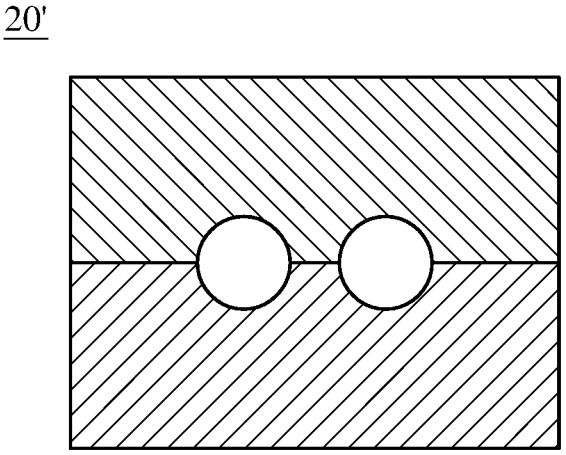
FIG. 12 is a cross-sectional view of a differential electromagnetic wave transmission board in accordance with yet still another embodiment of the disclosure.

Please refer to FIG. 12, which is a cross-sectional view of a differential electromagnetic wave transmission board 20' in accordance with another embodiment of the disclosure. In this embodiment, a configuration of the differential electromagnetic wave transmission board 20' is similar to that of the electromagnetic wave transmission board 20 in FIG. 3. The difference between the two embodiments is that, in this embodiment, there are two wave guiding spaces formed in the differential electromagnetic wave transmission board 20' and arranged side by side for transmitting differential signals.

Figure 13:
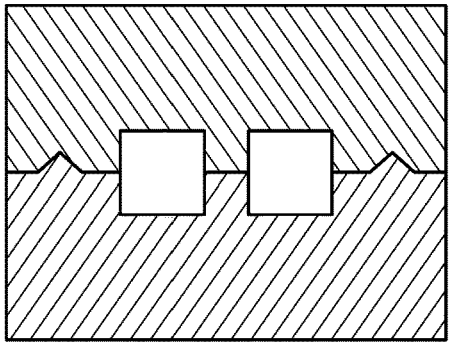
FIG. 13 is a cross-sectional view of a differential electromagnetic wave transmission board in accordance with yet still another embodiment of the disclosure.

Please refer to FIG. 13, which is a cross-sectional view of a differential electromagnetic wave transmission board 30' in accordance with another embodiment of the disclosure. In this embodiment, a configuration of the differential electromagnetic wave transmission board 30' is similar to that of the electromagnetic wave transmission board 30 in FIG. 4. The difference between the two embodiments is that, in this embodiment, there are two wave guiding spaces formed in the differential electromagnetic wave transmission board 30' and arranged side by side for transmitting differential signals.

Figure 14:
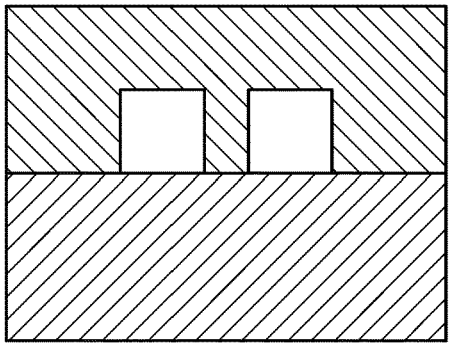
FIG. 14 is a cross-sectional view of a differential electromagnetic wave transmission board in accordance with yet still another embodiment of the disclosure.

Please refer to FIG. 14, which is a cross-sectional view of a differential electromagnetic wave transmission board 40' in accordance with another embodiment of the disclosure. In this embodiment, a configuration of the differential electromagnetic wave transmission board 40' is similar to that of the electromagnetic wave transmission board 40 in FIG. 5. The difference between the two embodiments is that, in this embodiment, there are two wave guiding spaces formed in the differential electromagnetic wave transmission board 40' and arranged side by side for transmitting differential signals.

Figure 15:
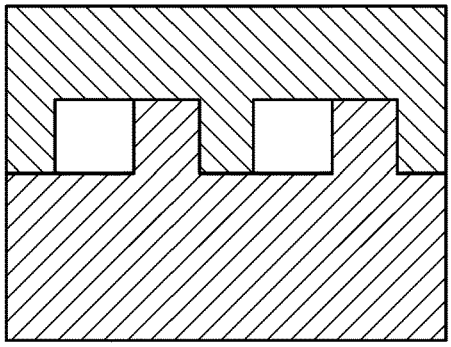
FIG. 15 is a cross-sectional view of a differential electromagnetic wave transmission board in accordance with yet still another embodiment of the disclosure.

Please refer to FIG. 15, which is a cross-sectional view of a differential electromagnetic wave transmission board 50' in accordance with another embodiment of the disclosure. In this embodiment, a configuration of the differential electromagnetic wave transmission board 50' is similar to that of the electromagnetic wave transmission board 50 in FIG. 6. The difference between the two embodiments is that, in this embodiment, there are two wave guiding spaces formed in the differential electromagnetic wave transmission board 50' and arranged side by side for transmitting differential signals.

Figure 16:
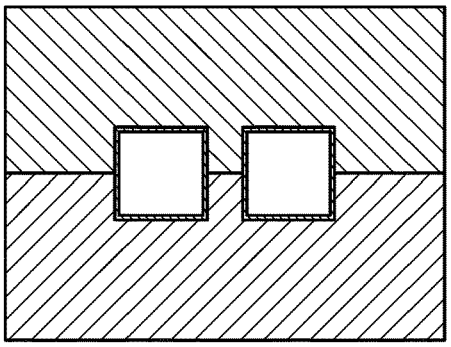
FIG. 16 is a cross-sectional view of a differential electromagnetic wave transmission board in accordance with yet still another embodiment of the disclosure.

Please refer to FIG. 16, which is a cross-sectional view of a differential electromagnetic wave transmission board 60' in accordance with another embodiment of the disclosure. In this embodiment, a configuration of the differential electromagnetic wave transmission board 60' is similar to that of the electromagnetic wave transmission board 60 in FIG. 9. The difference between the two embodiments is that, in this embodiment, there are two wave guiding spaces formed in the differential electromagnetic wave transmission board 60' and arranged side by side for transmitting differential signals.

Figure 17:
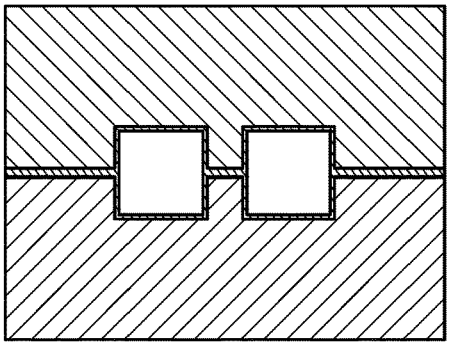
FIG. 17 is a cross-sectional view of a differential electromagnetic wave transmission board in accordance with yet still another embodiment of the disclosure.

Please refer to FIG. 17, which is a cross-sectional view of a differential electromagnetic wave transmission board 70' in accordance with another embodiment of the disclosure. In this embodiment, a configuration of the differential electromagnetic wave transmission board 70' is similar to that of the electromagnetic wave transmission board 70 in FIG. 10. The difference between the two embodiments is that, in this embodiment, there are two wave guiding spaces formed in the differential electromagnetic wave transmission board 70' and arranged side by side for transmitting differential signals.

Figure 18:
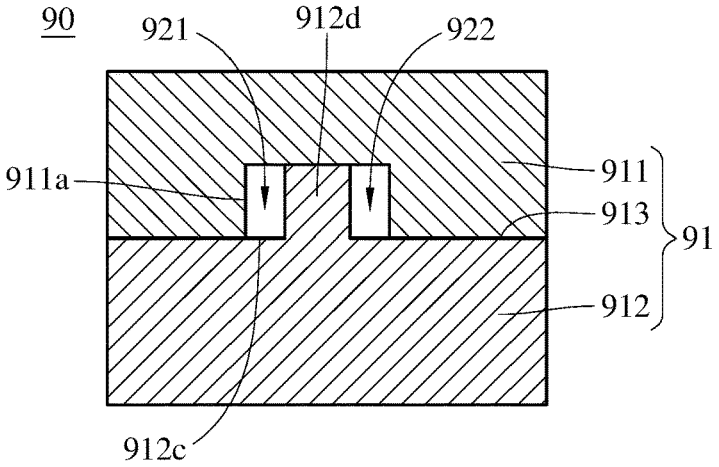
FIG. 18 is a cross-sectional view of a differential electromagnetic wave transmission board in accordance with another embodiment of the disclosure.

Please refer to FIG. 18, which is a cross-sectional view of a differential electromagnetic wave transmission board 90 in accordance with another embodiment of the disclosure. In this embodiment, the differential electromagnetic wave transmission board 90 includes a substrate 91. The substrate 91 includes a connecting layer 913, a first dielectric layer 911 and a second dielectric layer 912. The first dielectric layer 911 is stacked on the second dielectric layer 912. The first dielectric layer 911 has a groove 911*a*. A cross-section of the groove 911*a* is, but not limited to, bilaterally symmetrical. The second dielectric layer 912 has a surface 912*c* and a protrusion 912*d* protruding from the surface 912*c*. A width of the groove 911*a* is larger than a width of the protrusion 912*d*. The protrusion 912*d* is disposed in the groove 911*a*, and the protrusion 912*d* divides the groove 911*a* into a wave guiding space 921 and a wave guiding space 922 which are located side by side. The connecting layer 913 connects the first dielectric layer 911 and the second dielectric layer 912.

The first dielectric layer 911 and the second dielectric layer 912 are made of a dielectric material, such as glass or other dielectric materials. In this embodiment, the first dielectric layer 911 and the second dielectric layer 912 are made of the same dielectric material; however, in some other embodiments, the first dielectric layer 911 and the second dielectric layer 912 are made of different dielectric materials. A dielectric constant of the first dielectric layer 911 and a dielectric constant of the second dielectric layer 912 range from, for example, 1 to 100, wherein dielectric constant is, for example, referred to as relative permittivity, which is a ratio of the (absolute) permittivity of a material relative to the permittivity of vacuum. A surface roughness (Ra) of an inner surface of the wave guiding space 921, and a surface roughness (Ra) of an inner surface of the wave guiding space 922 range from, for example, 0.1 nm to 100 nm. In this embodiment, a cross-section of the wave guiding space 921 and a cross-section of the wave guiding space 922 are rectangular, but the present disclosure is not limited thereto. In other embodiments, the cross-section of the wave guiding space may be polygonal or half-circular.

The wave guiding space 921 and the wave guiding space 922 are vacuum or filled with air or other gases according to the external environment of the differential electromagnetic wave transmission board 90. In addition, the differential electromagnetic wave transmission board 90 may further include a filler (not shown in the drawings) according to requirements. The filler is filled in the wave guiding space 921 and the wave guiding space 922. A dielectric constant of the filler is, for example, different from the dielectric constants of the first dielectric layer 911 and the second dielectric layer 912. Moreover, the dielectric constant of the filler is, for example, greater than the dielectric constants of the first dielectric layer 911 and the second dielectric layer 912.

Figure 19:
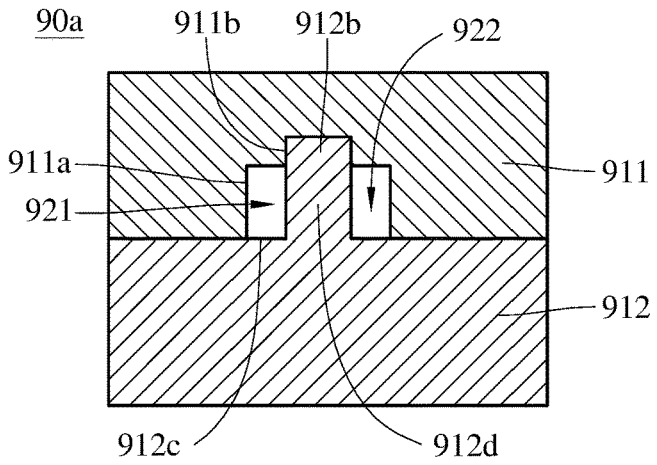
FIG. 19 is a cross-sectional view of a differential electromagnetic wave transmission board in accordance with yet still another embodiment of the disclosure.

Please refer to FIG. 19, which is a cross-sectional view of a differential electromagnetic wave transmission board 90*a* in accordance with another embodiment of the disclosure. In this embodiment, a configuration of the differential electromagnetic wave transmission board 90*a* is similar to that of the differential electromagnetic wave transmission board 90 in FIG. 18. The differences between the two embodiments are that: in this embodiment, the first dielectric layer 911 has the groove 911*a* and a recess 911*b* located on a side of the first dielectric layer 911 facing the second dielectric layer 912; the groove 911*a* is connected to the recess 911*b;* and the second dielectric layer 912 has the surface 912*c,* the protrusion 912*d* protruding from the surface 912*c,* and a block 912*b* located on top of the protrusion 912*d.* In detail, a width of the block 912*b* is equal to the width of the protrusion 912*d.* The protrusion 912*d* is disposed in the groove 911*a.* The recess 911*b* and the block 912*b* are engaged with each other. The protrusion 912*d* divides the groove 911*a* into the wave guiding space 921 and the wave guiding space 922 which are located side by side. In this embodiment, the recess 911*b* and the block 912*b* are, but not limited to, tightly in contact with each other.

Figure 20:
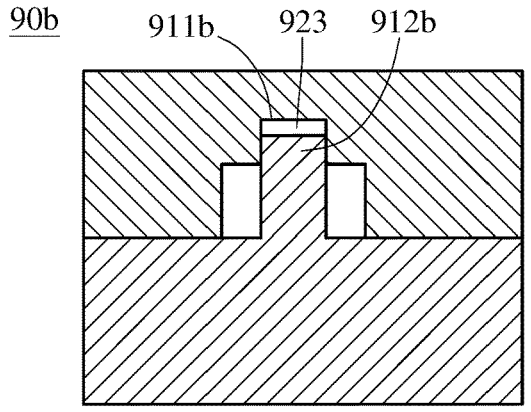
FIG. 20 is a cross-sectional view of a differential electromagnetic wave transmission board in accordance with yet still another embodiment of the disclosure.

Please refer to FIG. 20, which is a cross-sectional view of a differential electromagnetic wave transmission board 90*b* in accordance with another embodiment of the disclosure. In this embodiment, a configuration of the differential electromagnetic wave transmission board 90*b* is similar to that of the differential electromagnetic wave transmission board 90*a* in FIG. 19. The difference between the two embodiments is that, in this embodiment, the depth of the recess 911*b* in the first dielectric layer 911 is deeper, such that there is a gap 923 when the recess 911*b* and the block 912*b* are engaged with each other. Therefore, mechanical interference due to manufacturing tolerances during assembly can be prevented.

Figure 21:
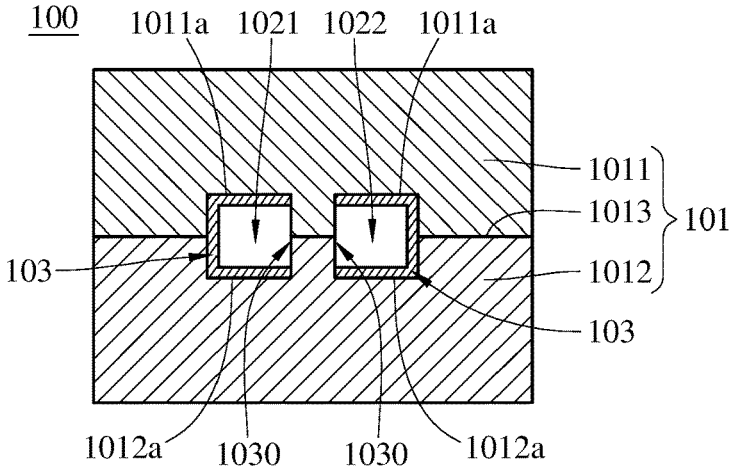
FIG. 21 is a cross-sectional view of a differential electromagnetic wave transmission board in accordance with yet still another embodiment of the disclosure.

Please refer to FIG. 21, which is a cross-sectional view of a differential electromagnetic wave transmission board 100 in accordance with another embodiment of the disclosure. In this embodiment, the differential electromagnetic wave transmission board 100 includes a substrate 101 and two auxiliary layers 103. The substrate 101 includes a connecting layer 1013, a first dielectric layer 1011 and a second dielectric layer 1012. The first dielectric layer 1011 is stacked on the second dielectric layer 1012. The first dielectric layer 1011 has two first grooves 1011*a* arranged side by side, and the second dielectric layer 1012 has two second grooves 1012*a* arranged side by side. The cross-sections of the two first grooves 1011*a* and the two second grooves 1012*a* are, but not limited to, rectangular. Each first groove 1011*a* and the corresponding second groove 1012*a* face each other. One set of the first groove 1011*a* and the second groove 1012*a* form a wave guiding space 1021, and the other set of the first groove 1011*a* and the second groove 1012*a* form a wave guiding space 1022. The two auxiliary layers 103 are respectively disposed on the inner surfaces of the first grooves 1011*a* and the inner surfaces of the second grooves 1012*a*. In other words, the two auxiliary layers 103 are respectively disposed on the inner surfaces of the wave guiding space 1021 and the wave guiding space 1022. Each auxiliary layer 103 has an opening 1030 facing each other. Therefore, the electromagnetic fields of differential electromagnetic wave transmitted by the wave guiding space 1021 and the wave guiding space 1022 are connected to each other to maintain the stability of the differential electromagnetic wave signals. The two auxiliary layers 103 are made of an electrically conductive material or a dielectric material. The electrically conductive material is, for example, a metal or a non-metallic material. A dielectric constant of the dielectric material is, for example, different from a dielectric constant of the first dielectric layer 1011 and a dielectric constant of the second dielectric layer 1012. For example, the dielectric constant of the dielectric material is 1000 or more. In this embodiment, the dielectric constant is referred to as the relative permittivity which is a ratio of the permittivity of the dielectric material relative to the permittivity of vacuum. The dielectric material is, for example, $BaTiO_3$. The connecting layer 1013 connects the first dielectric layer 1011 and the second dielectric layer 1012.

A material of the first dielectric layer 1011, a material of the second dielectric layer 1012 and the shape of the wave guiding spaces 1021, 1022 are, for example, the same as those of the differential electromagnetic wave transmission board 80 in FIG. 11. The surface roughnesses (Ra) of the inner surfaces of the two auxiliary layers 103 and the side wall of the wave guiding spaces 1021, 1022 corresponding to the opening 1030 range from, for example, 0.1 nm to 100 nm.

The chambers inside the wave guiding space 1021 and the wave guiding space 1022 are vacuum or filled with air or other gases according to the external environment of the differential electromagnetic wave transmission board 100. In addition, the differential electromagnetic wave transmission board 100 may further include a filler (not shown in the drawings) according to requirements. The filler is filled in the chambers of the wave guiding space 1021 and the wave guiding space 1022. A dielectric constant of the filler is, for example, different from the dielectric constants of the first dielectric layer 1011, the second dielectric layer 1012 and the two auxiliary layers 103. Moreover, the dielectric constant of the filler is, for example, greater than the dielectric constants of the first dielectric layer 1011 and the second dielectric layer 1012.

Figure 22:
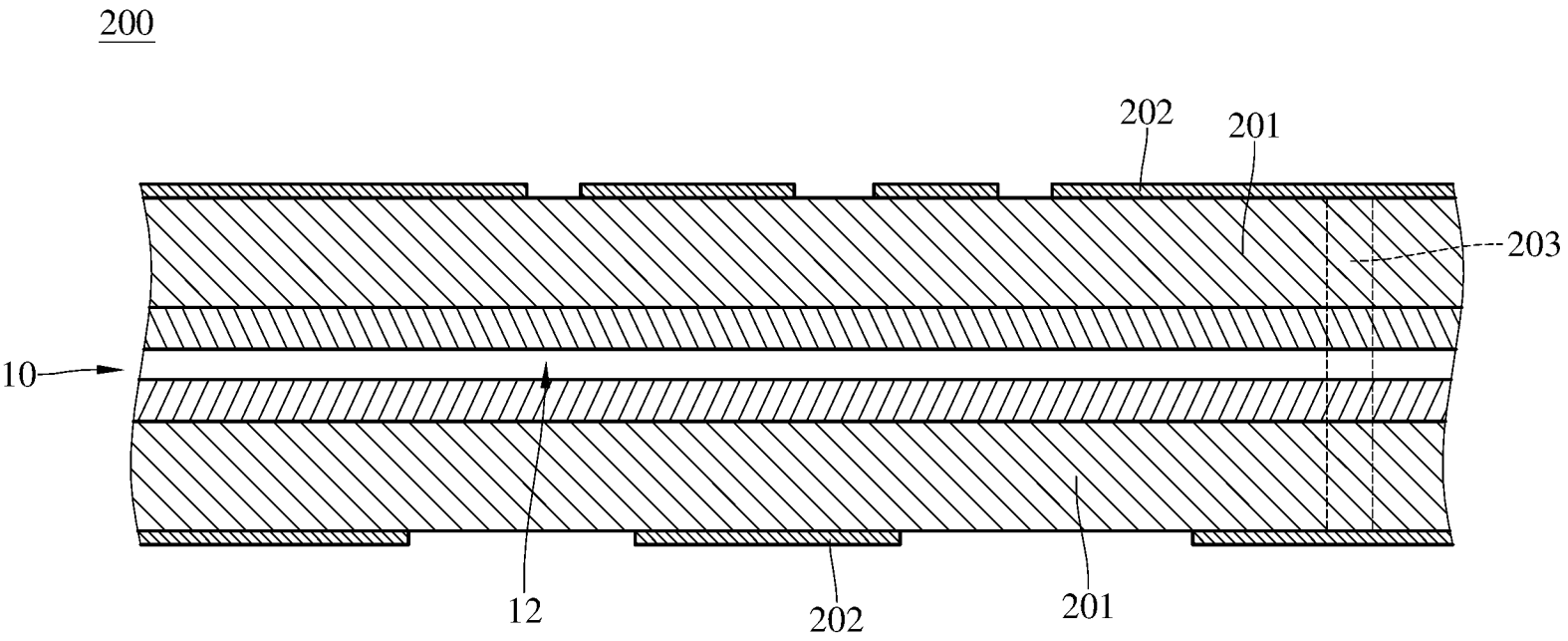
FIG. 22 shows an exemplary application of the electromagnetic wave transmission board in FIG. 1.

Please refer to FIG. 22, which shows an exemplary application of the electromagnetic wave transmission board 10 in FIG. 1. The electromagnetic wave transmission board 10 is applied to a printed circuit board 200 in this embodiment. A plurality of dielectric layers 201 are respectively formed on an upper surface and a lower surface of the electromagnetic wave transmission board 10. The materials of the dielectric layers 201 are, for example, polymer or other dielectric materials. Two conductive pattern layers 202 are respectively formed on the two surfaces of the dielectric layers 201. Moreover, a conductive via 203 penetrates through an area of the printed circuit board 200 where there is no wave guiding space 12; however, in some cases, a part of the conductive via 203 is located inside the wave guiding space 12. The conductive via 203 is electrically connected to different conductive pattern layers 202. The conductive via 203 is, for example, a solid column made of an electrically conductive material, a hollow column made of an electrically conductive material, or a hollow column made of an electrically conductive material filled with a filler. In this exemplary application, the wave guiding space 12 of the electromagnetic wave transmission board 10 is able to transmit electromagnetic wave, and by replacing a core layer of the printed circuit board 200 with the electromagnetic wave transmission board 10, the amount of signals transmitted in a horizontal direction through the printed circuit board 200 is increased.

In the exemplary application described above, the electromagnetic wave transmission board 10 in FIG. 1 is applied to the printed circuit board 200, but the present disclosure is not limited thereto. Except for the electromagnetic wave transmission board 10 in FIG. 1, another electromagnetic wave transmission board or one of the differential electromagnetic wave transmission boards of the present disclosure describe above may be applied to the printed circuit board 200 as another exemplary application.

Figure 23:
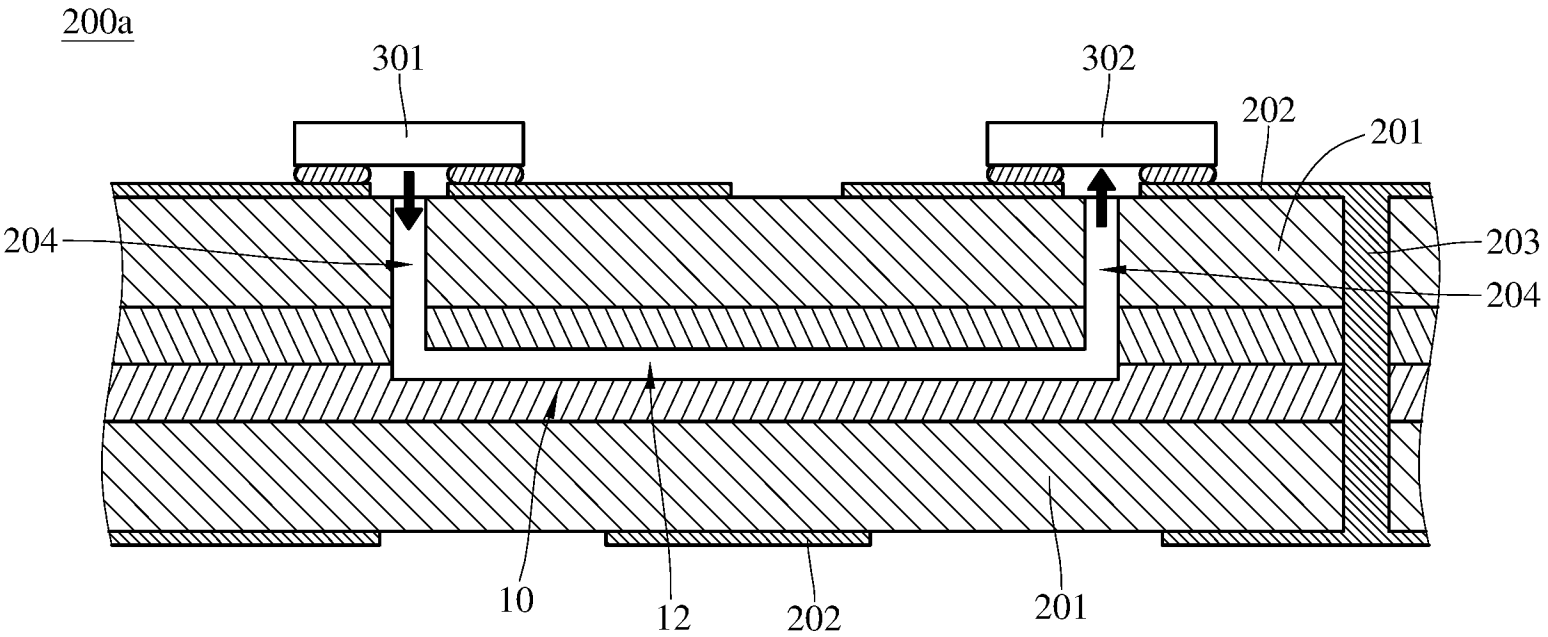
FIG. 23 shows another exemplary application of the electromagnetic wave transmission board in FIG. 1.

FIG. 23 shows another exemplary application of the electromagnetic wave transmission board 10 in FIG. 1. In a printed circuit board 200*a*, the dielectric layers 201 are respectively formed on an upper surface and a lower surface of the electromagnetic wave transmission board 10. The materials of the dielectric layers 201 are, for example, polymer or other dielectric materials. The two conductive pattern layers 202 are respectively formed on the surfaces of the dielectric layers 201. Moreover, the conductive via 203 penetrates through an area of the printed circuit board 200*a* where there is no wave guiding space 12; however, in some cases, a part of the conductive via 203 is located inside the wave guiding space 12. The conductive via 203 is electrically connected to different conductive pattern layers 202. The conductive via 203 is, for example, a solid column made of an electrically conductive material, a hollow column made of an electrically conductive material, or a hollow column made of an electrically conductive material filled with a filler. The printed circuit board 200*a* has two channels 204 connected to the wave guiding space 12 of the electromagnetic wave transmission board 10, and one end of each channel 204 is located on a surface of the printed circuit board 200*a*. An electromagnetic wave transmitter 301 and an electromagnetic wave receiver 302 are respectively disposed on the openings of the two channels 204. An electromagnetic wave transmitted by the electromagnetic wave transmitter 301 passes through one of the channels 204, the wave guiding space 12 of the electromagnetic wave transmission board 10 and the other one of the channels 204, and then the electromagnetic wave is received by the electromagnetic wave receiver 302. In this exemplary application, by replacing a core layer of the printed circuit board 200*a* with the electromagnetic wave transmission board 10, the amount of signals transmitted in a horizontal direction through the printed circuit board 200*a* is increased.

In the exemplary application described above, the electromagnetic wave transmission board 10 in FIG. 1 is applied to the printed circuit board 200*a*, but the present disclosure is not limited thereto. Except for the electromagnetic wave transmission board 10 in FIG. 1, another electromagnetic wave transmission board or one of the differential electromagnetic wave transmission boards of the present disclosure describe above may be applied to the printed circuit board 200*a* as another exemplary application.

Figure 24:
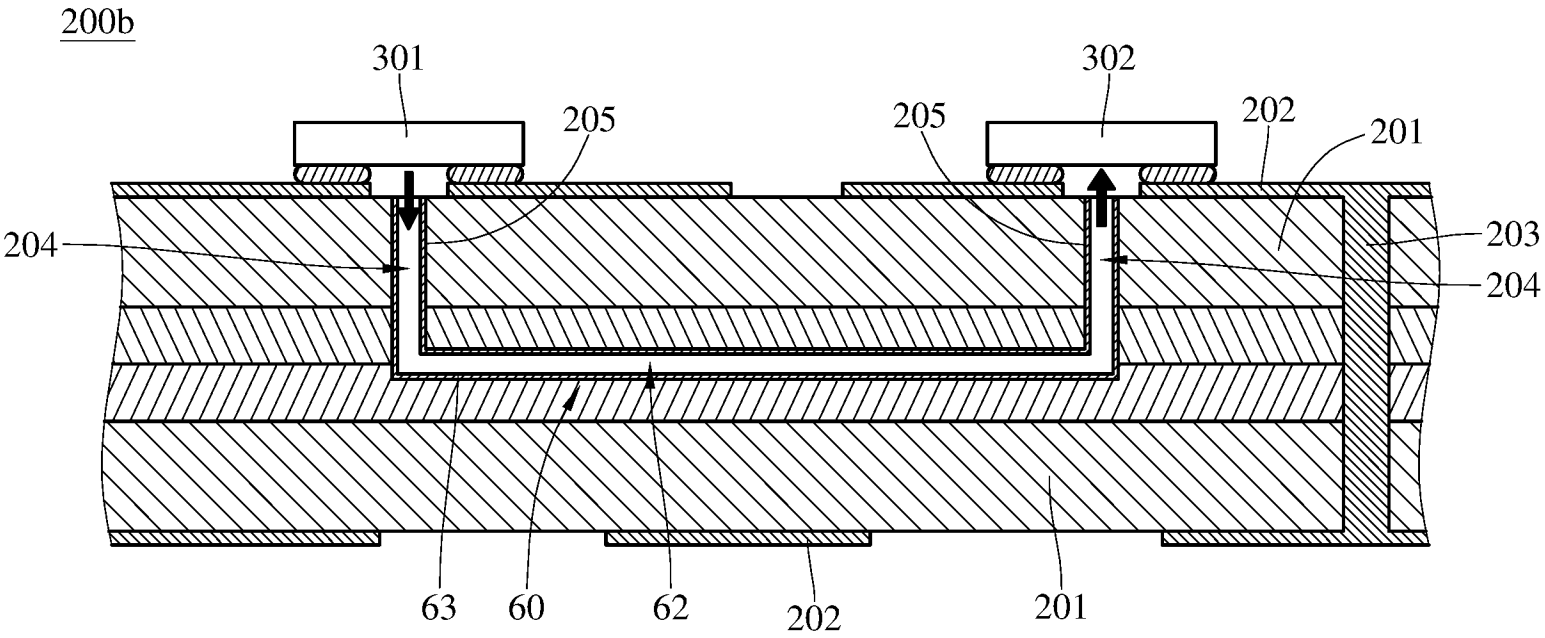
FIG. 24 shows an exemplary application of the electromagnetic wave transmission board in FIG. 9.

FIG. 24 shows an exemplary application of the electromagnetic wave transmission board 60 in FIG. 9. The electromagnetic wave transmission board 60 is applied to a printed circuit board 200*b* in this embodiment. The dielectric layers 201 are respectively formed on an upper surface and a lower surface of the electromagnetic wave transmission board 60. The materials of the dielectric layers 201 are, for example, polymer or other dielectric materials. The two conductive pattern layers 202 are respectively formed on the two surfaces of the dielectric layers 201. Moreover, the conductive via 203 penetrates through an area of the printed circuit board 200*b* where there is no the wave guiding space 12; however, in some cases, a part of the conductive via 203 is located inside the wave guiding space 12. The conductive via 203 is electrically connected to different the conductive pattern layers 202. The conductive via 203 is, for example, a solid column made of an electrically conductive material, a hollow column made of an electrically conductive material, or a hollow column made of an electrically conductive material filled with a filler. The printed circuit board 200*b* has two channels 204 connected to the wave guiding space 62 of the electromagnetic wave transmission board 60, and one end of each channel 204 is located on a surface of the printed circuit board 200*b*. Two auxiliary layers 205 are respectively disposed on the inner surfaces of the two channels 204. The two auxiliary layers 205 are connected to the auxiliary layer 63 of the electromagnetic wave transmission board 60. A material of the auxiliary layers 205 is, for example, the same as a material of the auxiliary layer 63. The electromagnetic wave transmitter 301 and the electromagnetic wave receiver 302 are respectively disposed on the openings of the two channels 204. An electromagnetic wave transmitted by the electromagnetic wave transmitter 301 passes through one of the channels 204, the wave guiding space 62 of the electromagnetic wave transmission board 60 and the other one of the channels 204, and then is received by the electromagnetic wave receiver 302. In this exemplary application, by replacing a core layer of the printed circuit board 200*b* with the electromagnetic wave transmission board 60, the amount of signals transmitted in a horizontal direction through the printed circuit board 200*b* is increased.

In the exemplary application described above, the electromagnetic wave transmission board 60 in FIG. 9 is applied to the printed circuit board 200*b*, but the present disclosure is not limited thereto. The electromagnetic wave transmission board 70 in FIG. 10 and the differential electromagnetic wave transmission boards 60', 70' 100 in FIG. 16, 17, 21 are all applicable to printed circuit board.

Figure 25:
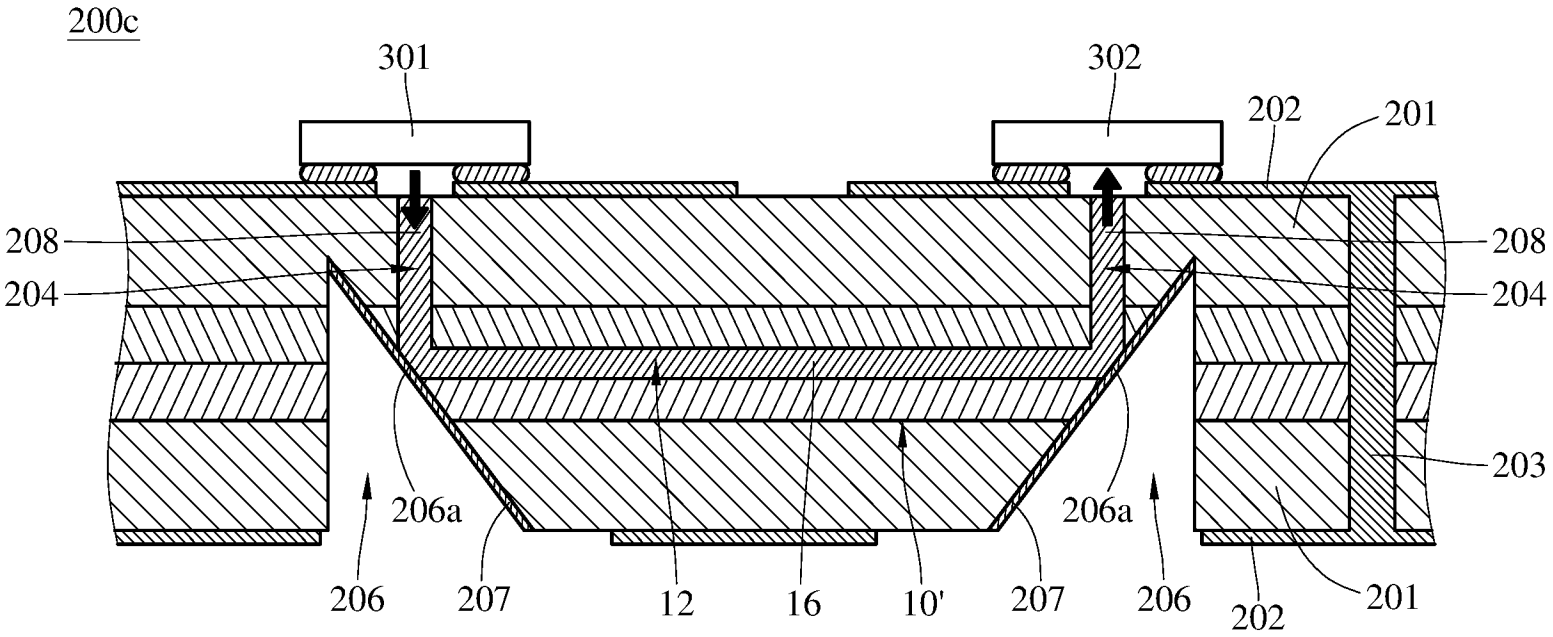
FIG. 25 shows an exemplary application of an electromagnetic wave transmission board in accordance with yet still another embodiment of the disclosure.

FIG. 25 shows an exemplary application of an electromagnetic wave transmission board 10' in accordance with yet still another embodiment of the disclosure. The electromagnetic wave transmission board 10' is similar to the electromagnetic wave transmission board 10 in FIG. 1. The differences between the two embodiments are that, in this embodiment, the wave guiding space 12 is filled with a solid filler 16, and the dielectric layers 201 are respectively formed on an upper surface and a lower surface of the electromagnetic wave transmission board 10' in a printed circuit board 200*c*. The materials of the dielectric layers 201 are, for example, polymer or other dielectric materials. The two conductive pattern layers 202 are respectively formed on the two surfaces of the dielectric layers 201. Moreover, the conductive via 203 penetrates through an area of the printed circuit board 200*c* where there is no wave guiding space 12; however, in some cases, a part of the conductive via 203 is located inside the wave guiding space 12. The conductive via 203 is electrically connected to different conductive pattern layers 202. The conductive via 203 is, for example, a solid column made of an electrically conductive material, a hollow column made of an electrically conductive material, or a hollow column made of an electrically conductive material filled with a filler. The printed circuit board 200*c* has two channels 204 connected to the wave guiding space 12 of the electromagnetic wave transmission board 10', and an end of each channel 204 is located on a surface of the printed circuit board 200*c*. A filler 208 is filled in the two channels 204. A material of the filler 208 is, for example, the same as a material of the filler 16. The electromagnetic wave transmitter 301 and the electromagnetic wave receiver 302 are respectively disposed on the openings of the two channels 204. The printed circuit board 200*c* further has two open recesses 206. An inclined surface 206*a* of each open recess 206 passes through the intersection of one of the channels 204 and the wave guiding space 12. Two electromagnetic wave reflecting layers 207 are respectively disposed on the inclined surfaces 206*a*. In this embodiment, the electromagnetic wave reflecting layers 207 are made of metal, but the present disclosure is not limited thereto. In other embodiments, the electromagnetic wave reflecting layers 207 may be made of a non-metallic material, or there is no electromagnetic wave reflecting layer on the inclined surfaces.

An electromagnetic wave transmitted by the electromagnetic wave transmitter 301 passes through one of the channels 204, and then its transmitting direction is changed by one of the electromagnetic wave reflecting layers 207. The electromagnetic wave passes through the wave guiding space 12 of the electromagnetic wave transmission board 10', and then its transmitting direction is changed again by the other one of the electromagnetic wave reflecting layers 207. The electromagnetic wave passes through the other one of the channels 204, and then the electromagnetic wave is received by the electromagnetic wave receiver 302. In other embodiments, where there is no electromagnetic wave reflecting layer on the inclined surfaces, an electromagnetic wave is reflected and its the transmitting direction is changed by the inclined surfaces 206*a*. In this exemplary application, by replacing a core layer of the printed circuit board 200*c* with the electromagnetic wave transmission board 10', the amount of signals transmitted in a horizontal direction through the printed circuit board 200*c* is increased.

In the exemplary application described above, the electromagnetic wave transmission board 10' is applied to the printed circuit board 200*c*, but the present disclosure is not limited thereto. Except for the electromagnetic wave transmission board 10', another electromagnetic wave transmission board or one of the differential electromagnetic wave transmission boards of the present disclosure describe above having the filler 16 filled in the wave guiding space thereof may be applied to the printed circuit board 200*c* as another exemplary application.

According to the electromagnetic wave transmission board or the differential electromagnetic wave transmission board as described above, when the electromagnetic wave signals or differential electromagnetic wave signals are transmitted through the wave guiding space at high speed or high frequency, it is possible to maintain the accuracy and strength of the signals. In addition, the electromagnetic wave transmission board or the differential electromagnetic wave transmission board in accordance with one embodiment of the present disclosure can be applied to a printed circuit board as a core layer so as to increase the signal transmission density of the printed circuit board, and therefore it is favorable for making light and small electronic devices.

The embodiments were chosen and described in order to best explain the principles of the disclosure and its practical applications, to thereby enable others skilled in the art to best utilize the disclosure and various embodiments with various modifications as are suited to the particular use contemplated. It is intended that the scope of the disclosure be defined by the following claims and their equivalents.

What is claimed is:

1. An electromagnetic wave transmission board, comprising a substrate, the substrate comprising a first dielectric layer and a second dielectric layer, the first dielectric layer stacked on the second dielectric layer, the first dielectric layer and the second dielectric layer together forming a wave guiding space, the wave guiding space configured for transmitting electromagnetic wave, wherein the first dielectric layer has a groove, the second dielectric layer has a surface and a protrusion protruding from the surface, a width of the groove is larger than a width of the protrusion, the protrusion is disposed in the groove, the groove, the protrusion and the surface of the second dielectric layer together form the wave guiding space.

2. The electromagnetic wave transmission board according to claim 1, wherein the first dielectric layer has a first positioning portion, the second dielectric layer has a second positioning portion, and the first positioning portion and the second positioning portion are engaged with each other.

3. The electromagnetic wave transmission board according to claim 1, wherein the first dielectric layer further has a recess located on a side of the first dielectric layer facing the second dielectric layer, the groove is connected to the recess, the second dielectric layer further has a block located on top of the protrusion, a width of the block is substantially equal to the width of the protrusion, the protrusion is disposed in the groove, the recess and the block are engaged with each other.

4. The electromagnetic wave transmission board according to claim 1, wherein the substrate further comprises a connecting layer, the connecting layer connects the first dielectric layer and the second dielectric layer.

5. The electromagnetic wave transmission board according to claim 1, further comprising a filler filled in the wave guiding space, wherein a dielectric constant of the filler is different from a dielectric constant of the first dielectric layer, and the dielectric constant of the filler is different from a dielectric constant of the second dielectric layer.

6. The electromagnetic wave transmission board according to claim 5, further comprising an auxiliary layer disposed on an inner surface of the wave guiding space, the auxiliary layer forming an accommodation portion in the wave guiding space, the filler filled in the accommodation portion, the auxiliary layer made of an electrically conductive material or a dielectric material, and the dielectric material having a dielectric constant different from the dielectric constants of the first dielectric layer, the second dielectric layer and the filler.

7. The electromagnetic wave transmission board according to claim 1, further comprising an auxiliary layer disposed on an inner surface of the wave guiding space, the auxiliary layer made of an electrically conductive material or a dielectric material, and the dielectric material having a dielectric constant different from the dielectric constants of the first dielectric layer and the second dielectric layer.

8. The electromagnetic wave transmission board according to claim 7, further comprising an interlayer stacked between the first dielectric layer and the second dielectric layer, the interlayer connected to the layer, and the interlayer and the auxiliary layer made of the same material.

9. A differential electromagnetic wave transmission board, comprising a substrate, the substrate comprising a first dielectric layer and a second dielectric layer, the first dielectric layer stacked on the second dielectric layer, the first dielectric layer and the second dielectric layer together forming two wave guiding spaces arranged side by side, the two wave guiding spaces configured for transmitting differential electromagnetic wave, wherein the first dielectric layer has a groove, the second dielectric layer has a surface and a protrusion protruding from the surface, a width of the groove is larger than a width of the protrusion, the protrusion is disposed in the groove, and the protrusion divides the groove into the two wave guiding spaces.

10. The differential electromagnetic wave transmission board according to claim 9, wherein the first dielectric layer has a first positioning portion, the second dielectric layer has a second positioning portion, and the first positioning portion and the second positioning portion are engaged with each other.

11. The differential electromagnetic wave transmission board according to claim 9, wherein the first dielectric layer has a first positioning portion located in the groove, the second dielectric layer has a second positioning portion located on the protrusion, and the first positioning portion and the second positioning portion are engaged with each other.

12. The differential electromagnetic wave transmission board according to claim 9, wherein the substrate further comprises a connecting layer, and the connecting layer connects the first dielectric layer and the second dielectric layer.

13. The differential electromagnetic wave transmission board according to claim 9, further comprising two fillers, each of the fillers filled in the corresponding one of the waveguiding spaces, wherein a dielectric constant of each of the fillers is different from a dielectric constant of the first dielectric layer, and the dielectric constant of each of the fillers is different from a dielectric constant of the second dielectric layer.

14. The differential electromagnetic wave transmission board according to claim 13, further comprising two auxiliary layers, each of the auxiliary layers disposed on an inner surface of the corresponding one of the wave guiding spaces and forming an accommodation portion in the corresponding one of the wave guiding spaces, each of the fillers filled in the corresponding one of the accommodation portions, each of the auxiliary layers made of an electrically conductive material or a dielectric material, and the dielectric material having a dielectric constant different from the dielectric constants of the first dielectric layer, the second dielectric layer and the two fillers.

15. The differential electromagnetic wave transmission board according to claim 9, further comprising two auxiliary layers, each of the auxiliary layers disposed on an inner surface of the corresponding one of the wave guiding spaces, each of the auxiliary layers made of an electrically conductive material or a dielectric material, the dielectric material having a dielectric constant different from the dielectric constants of the first dielectric layer and the second dielectric layer.

16. The differential electromagnetic wave transmission board according to claim 15, wherein each of the auxiliary layers has an opening, and the two openings face each other.

17. The differential electromagnetic wave transmission board according to claim 15, further comprising an interlayer stacked between the first dielectric layer and the second dielectric layer, the interlayer connected to the two auxiliary layers, and the interlayer and the two auxiliary layers made of the same material.

* * * * *